US010012245B2

(12) United States Patent
Nadeau et al.

(10) Patent No.: US 10,012,245 B2
(45) Date of Patent: Jul. 3, 2018

(54) PYROTECHNIC ACTUATOR

(71) Applicant: AIRBUS SAFRAN LAUNCHERS SAS, Paris (FR)

(72) Inventors: Jean-Paul Nadeau, Ollioules (FR); Frédéric Marlin, Saint Medard en Jalles (FR)

(73) Assignee: ARIANEGROUP SAS, Paris (FR)

( * ) Notice: Subject to any disclaimer, the term of this patent is extended or adjusted under 35 U.S.C. 154(b) by 0 days.

(21) Appl. No.: 15/509,594

(22) PCT Filed: Sep. 8, 2015

(86) PCT No.: PCT/EP2015/070521

§ 371 (c)(1),
(2) Date: Mar. 8, 2017

(87) PCT Pub. No.: WO2016/038050

PCT Pub. Date: Mar. 17, 2016

(65) Prior Publication Data

US 2017/0261016 A1 Sep. 14, 2017

(30) Foreign Application Priority Data

Sep. 9, 2014 (EP) ..... 14306383

(51) Int. Cl.
*F42B 3/26* (2006.01)
*F15B 15/19* (2006.01)
*F15B 15/20* (2006.01)

(52) U.S. Cl.
CPC ..... *F15B 15/19* (2013.01); *F15B 15/20* (2013.01); *F42B 3/26* (2013.01)

(58) Field of Classification Search
CPC .. F41A 9/29; F42B 3/26; F42B 33/008; F15B 15/19; F15B 15/20; F15B 15/1447; F15B 15/1452
See application file for complete search history.

(56) References Cited

U.S. PATENT DOCUMENTS 2,320,680 A * 6/1943 Temple ..... B21D 39/04 123/24 A
2,469,660 A * 5/1949 Martin ..... B64C 11/34 123/183.1

(Continued)

FOREIGN PATENT DOCUMENTS

DE 103 37 958 A1 8/2004
DE 10 2005 001 115 A 7/2006

(Continued)

OTHER PUBLICATIONS

International Search Report as issued in International Patent Application No. PCT/EP2015/070521, dated Nov. 6, 2015.

(Continued)

*Primary Examiner* — Derrick R Morgan
(74) *Attorney, Agent, or Firm* — Pillsbury Winthrop Shaw Pittman LLP

(57) ABSTRACT

A pyrotechnic actuator includes a body, and a propelling system including a pyrotechnic igniter mounted inside the body. The pyrotechnic igniter is mounted inside the body such that a peripheral gap is formed between the body and the pyrotechnic igniter and the propelling system further includes a sealing gasket arranged inside the gap in such a manner that the pyrotechnic igniter is maintained in position with respect to the body.

17 Claims, 4 Drawing Sheets

(56) References Cited

U.S. PATENT DOCUMENTS 2,485,921 A * 10/1949 Rockwell ..... B63B 23/58 114/367
2,927,498 A * 3/1960 Eilers ..... F42B 3/103 102/202.14
3,133,408 A * 5/1964 Stott ..... B64C 1/32 60/636
3,386,334 A * 6/1968 Temple ..... F42C 7/12 42/106
3,393,605 A * 7/1968 Parnell ..... B63G 7/02 30/180
3,672,254 A * 6/1972 Travor ..... F42B 3/006 102/393
3,794,794 A * 2/1974 Provancher ..... B60R 21/0136 200/300
3,910,154 A * 10/1975 Gardner ..... F16B 37/0864 411/434
4,140,041 A * 2/1979 Frelau ..... B21D 26/08 137/68.13
4,244,386 A * 1/1981 Hardesty ..... F16K 13/06 137/625.38
5,634,660 A * 6/1997 Fink ..... B60R 21/2644 102/202.14
6,073,963 A * 6/2000 Hamilton ..... B60R 21/26 102/202.14
6,496,098 B1 * 12/2002 Kern ..... F42B 3/006 337/182
6,629,486 B2 * 10/2003 Forys ..... B64G 1/641 411/434
6,796,580 B1 * 9/2004 Kubo ..... B60R 21/2644 102/202.14
6,925,939 B2 * 8/2005 Cleveland ..... B64G 1/645 102/378
7,078,635 B2 * 7/2006 Kordel ..... H01H 39/006 200/61.08
7,114,427 B1 * 10/2006 Avetisian ..... F16B 31/005 89/1.14
7,188,558 B2 * 3/2007 Brede ..... F15B 15/19 102/335
7,498,531 B2 * 3/2009 Knauss ..... H01H 39/006 200/61.08
7,745,745 B2 * 6/2010 Kordel ..... B23D 15/145 200/61.08
7,762,189 B2 * 7/2010 Ritchie ..... F42B 3/006 102/202.5
8,015,906 B2 * 9/2011 Ito ..... B60R 21/239 102/531
8,596,179 B2 * 12/2013 Enzmann ..... B29C 45/14311 137/68.13
8,716,615 B2 * 5/2014 Fukuyama ..... H01H 39/006 200/61.08
9,324,522 B2 * 4/2016 Nakamura ..... H01H 39/006
2001/0025564 A1 * 10/2001 Forys ..... B64G 1/641 89/1.14
2004/0211313 A1 10/2004 Yamaguchi
2005/0034595 A1 * 2/2005 Kordel ..... B23D 15/145 89/1.14
2005/0115390 A1 * 6/2005 Brede ..... B23D 15/145 89/1.14
2005/0126416 A1 * 6/2005 Clark ..... F42B 3/195 102/202.12
2006/0027120 A1 * 2/2006 Smith ..... F42B 3/006 102/202.12
2006/0230914 A1 * 10/2006 Schmid ..... F42B 3/26 89/1.14
2013/0038046 A1 * 2/2013 Inuzuka ..... B23D 15/145 280/743.2
2016/0001736 A1 * 1/2016 Van Hooser ..... F15B 15/19 89/1.14

FOREIGN PATENT DOCUMENTS

DE 20 2010 013 801 U1 1/2011
FR 2 961 273 A1 12/2011
FR 2961273 A1 * 12/2011 ..... B60R 21/38
WO WO 2012/044377 A1 4/2012

OTHER PUBLICATIONS

International Preliminary Report on Patentability and the Written Opinion of the International Searching Authority as issued in International Patent Application No. PCT/EP2015/070521, dated Mar. 14, 2017.

* cited by examiner

PYROTECHNIC ACTUATOR

CROSS REFERENCE TO RELATED APPLICATIONS

This application is the U.S. National Stage of PCT/EP2015/070521 filed Sep. 8, 2015, which in turn claims priority to European Application No. 14306383.2, filed Sep. 9, 2014. The contents of both applications are incorporated herein by reference in their entirety.

TECHNICAL FIELD

The invention relates to a pyrotechnic device, and more particularly to a pyrotechnic actuator.

BACKGROUND OF THE INVENTION

Pyrotechnic actuators are widely used, notably in pyrotechnic circuit breakers, electric switches, or pyrotechnic safety systems such as automatic hood-raising systems of motor vehicles.

They typically comprise a body defining an internal cavity and a pyrotechnic igniter housed in the cavity and typically facing a piston, the pyrotechnic igniter being capable of propelling the piston.

In the initial, non-activated, state of the actuator, it is necessary that the pyrotechnic igniter is reliably maintained in position, to avoid any malfunction of the actuator before and during activation.

Several solutions have been considered to meet such requirement.

In some actuators, the igniter is mounted in the body and fixed thereto by bonding. However, such an assembling method is complicated and cost-intensive.

As another example, U.S. Pat. No. 7,745,745 discloses an assembling method in which the body of the actuator is moulded around the igniter, the igniter and the actuator thus being unitary.

This method, however, requires particular equipment and the molding step is not easily integrated in the assembly process.

SUMMARY OF THE INVENTION

The present invention aims at providing an improved actuator for responding to the above-mentioned technical issues.

With this respect, the present invention relates to a pyrotechnic actuator comprising a body, and a propelling system comprising a pyrotechnic igniter mounted inside said body, the pyrotechnic igniter being mounted inside the body such that a peripheral gap is formed between the body and the pyrotechnic igniter and the propelling system further comprises a sealing gasket arranged inside the gap in such a manner that the pyrotechnic igniter is maintained in position with respect to the body.

With such arrangement, the igniter is easily assembled in the body. It is then reliably maintained in a suitable position through the (first) sealing gasket, which surrounds the igniter, even after actuation and propelling of the piston. This ensures a proper functioning of the actuator upon activation.

At the same time, the sealing gasket is configured to provide a sealing between the pyrotechnic igniter and the body. The sealing gasket avoids that undesirable elements penetrate inside the body before activation of the actuator, and further avoids that gases which may be generated by the pyrotechnic igniter flow outside the body.

Consequently, the sealing gasket has two different functions: a sealing function and a holding function for the pyrotechnic igniter before, during and after operation.

Typically, the gap formed between the body and the pyrotechnic igniter extends around a main axis, which is generally the axis of the pyrotechnic igniter. For example, the gap has an annular shape centred on said main axis.

According to an embodiment, the gap is delimited by an internal face of the body substantially parallel to said main axis, and the sealing gasket arranged inside the gap contacts said internal face of the body.

The internal face substantially parallel to the main axis should typically be understood as forming with this axis an angle comprised between 0 and 20°.

Generally, the sealing gasket is compressed inside the gap in a direction substantially perpendicular to said main axis.

The pyrotechnic actuator further comprises a piston slidably mounted inside the body along a longitudinal direction, the pyrotechnic igniter being adapted to propel said piston.

Typically, the longitudinal direction is parallel to the above-mentioned main axis.

Generally, an expansion chamber is defined between the pyrotechnic igniter and the piston, and the pyrotechnic igniter is adapted to pressurize said expansion chamber to propel the piston.

According to an embodiment, the piston comprises blocking means adapted to block the propelling system in the longitudinal direction when the piston is in an initial position.

The blocking means form a blocking system which blocks the pyrotechnic igniter and/or the sealing gasket in the longitudinal direction so that the pyrotechnic igniter is constantly maintained in position with respect to the body by means of the sealing gasket.

The blocking means may be in contact with the propelling system. They may either simply abut on the propelling system, or mechanically cooperate therewith to impart thereon a compression force, oriented towards the body.

According to still another embodiment, the blocking means could also be remote from the propelling system, so as to allow a small displacement thereof in the longitudinal direction. In that case however, the displacement permitted by the blocking means does not go beyond a predetermined limit, to ensure that, at any time, the pyrotechnic igniter be maintained in position with respect to the body.

For example, the blocking means may comprise at least one blocking part configured to cooperate with the pyrotechnic igniter in a shape-fitting manner when the piston is in the initial position. The pyrotechnic igniter is so reliably maintained in position by the sealing gasket and further prevented from moving by the piston.

For example, the blocking means may comprise at least one blocking part configured to be inserted in the gap to block the sealing gasket when the piston is in the initial position. This, on the one hand, prevents the pyrotechnic igniter from moving due to a displacement of the sealing gasket and on the other hand ensures that the expansion chamber be reliably isolated from the exterior before actuation.

The piston may of course be provided with two or more blocking parts configured as defined hereabove.

According to an embodiment, the actuator comprises engagement means for releasably attaching the piston with respect to the body in the initial position.

The engagement means form an attaching system which is adapted to maintain the piston in the initial position as long as the pyrotechnic igniter has not been activated. The piston is so blocked in the longitudinal direction. The blocking force provided by the engagement means is chosen to avoid any malfunction before activation of the pyrotechnic igniter such as undesirable displacement of the piston due to shocks, and to allow the piston to be safely propelled when the pyrotechnic igniter is activated. Such blocking force so depends on the pressurizing force of the pyrotechnic igniter.

The engagement means usually comprise an engagement part formed on the piston and a corresponding engagement part, usually of complementary shape, formed on the housing.

According to an embodiment, the engagement means comprise at least a recess formed on one of an external face of the piston and an internal face of the body and at least a bulge formed on the other of an external face of the piston and an internal face of the body, the recess and the bulge being adapted to engage each other to block the piston with respect to the body in the longitudinal direction.

According to an embodiment, the bulge may be a rib, generally defined in a plane perpendicular to the longitudinal direction.

For example, such rib may extend on a limited angular portion of the inner circumference of the body or the outer periphery of the piston. In that case, the engagement means may comprise two or more such rib segments, preferably between two to four rib segments.

According to a particular embodiment, the rib may also be a circumferential rib extending continuously all along the inner periphery of the body or the outer periphery of the piston.

The force for releasing the movement of the piston from its initial position may be adjusted by suitable choice of the respective shape and dimension of the bulge(s) and corresponding recess(es).

According to an embodiment, the piston may have a cylindrical shape having a longitudinal axis, and the actuator may comprise an indexing system for indexing the piston with respect to the body in a defined angular position around the longitudinal axis.

For example, the indexing system may comprise at least one slit formed on one of the piston and the body and at least one corresponding rib formed on the other of the piston and the body, the slit and the rib being configured to cooperate in the defined angular position of the piston.

According to an embodiment, the piston may further comprise on its external face a groove in which is arranged a second sealing gasket.

A calibrated passage adapted to evacuate gas may be formed between the second sealing gasket and the wall of said groove.

According to an aspect of the invention, the calibrated passage may comprise at least one slot formed in a wall of the groove, and in particular a slot formed directly in the piston. Such a slot is very easy and inexpensive to produce. It is easily reproducible, needs no extra pieces, and involves no particular assembly.

Such calibrated passage generates a local decompression of the second sealing gasket, allowing a small leakage of air from the space delimited by the body, pyrotechnic igniter and piston, when the piston is mounted in said internal cavity. The slot forms a leakage port for air upon assembly of the actuator, but does not have any significant effect during the stage in which the piston is propelled as a result of activation of the pyrotechnic igniter.

The pyrotechnic igniter and the (first) sealing gasket are disposed in a first recess formed in a wall of the body. The internal face of the body delimiting the gap formed between the body and the pyrotechnic igniter is the internal face of said first recess.

The piston is also provided with a skirt formed on its side facing the pyrotechnic igniter. This skirt allows increasing the sliding surface of the piston, and therefore ensures a safe displacement of the piston inside the body.

For the sake of compactness of the actuator, the body has a peripheral recess surrounding the first recess, and the skirt is mounted in said peripheral recess when the piston is in its initial position. For example, the pyrotechnic actuator according to the present invention may be a pyrotechnic circuit breaker, an electric switch, or a pyrotechnic safety system such as automatic hood-raising systems of a motor vehicle. These examples are, however, not limitative.

PRESENTATION OF THE DRAWINGS

Other features, aims and advantages of the invention will be detailed in the following description, which is purely illustrative and should not be interpreted in a limiting way, and which should be read in view of the enclosed drawings, wherein.

In all these figures, the common elements are identified by identical numeral references.

DETAILED DESCRIPTION

Figure 1:
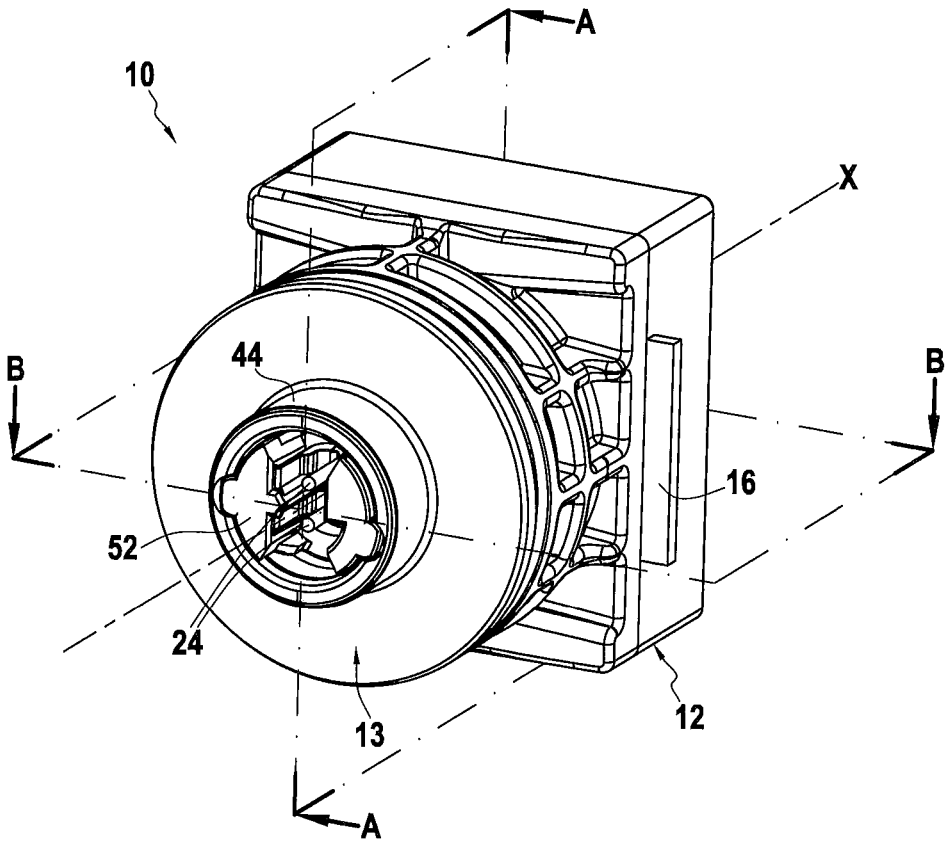
FIG. 1 is an upper perspective view of a pyrotechnic actuator according to an aspect of the invention.

FIG. 1 illustrates a pyrotechnic actuator 10 according to an aspect of the present invention. In the example, the pyrotechnic actuator 10 is a pyrotechnic circuit breaker. It is understood, however, that all features described hereafter may also be applicable to any other type of pyrotechnic actuator according to the invention.

Figure 2:
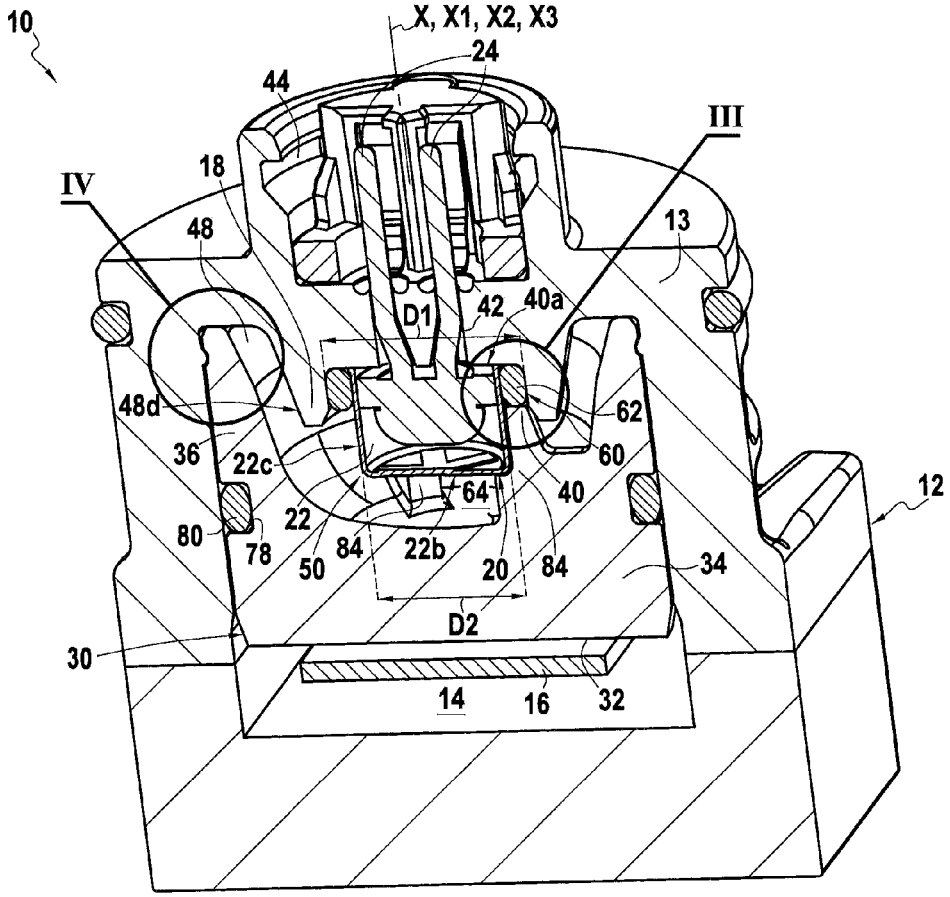
FIG. 2 is a perspective cross-section view of the pyrotechnic actuator according to FIG. 1, along the plane A-A of FIG. 1, showing the actuator in a non-activated state.
Figure 5:
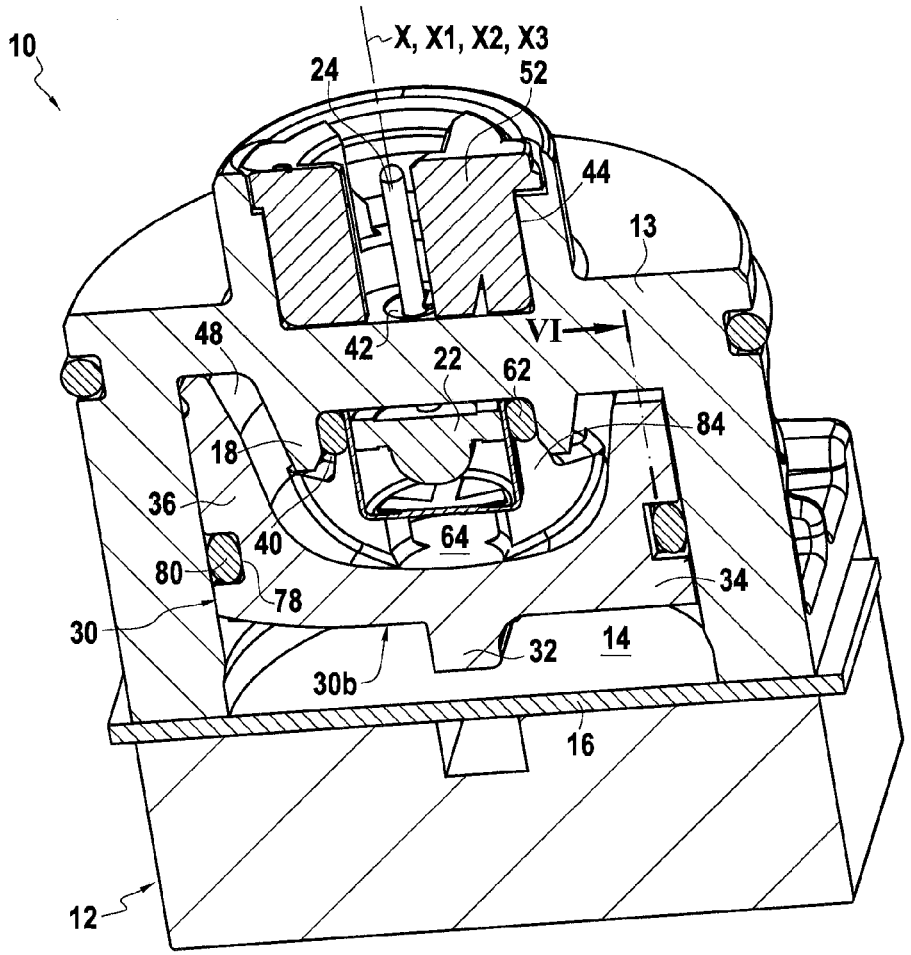
FIG. 5 is a perspective cross-section view of the pyrotechnic circuit breaker according to FIG. 1, along the plane B-B of FIG. 1.

As shown in FIGS. 1, 2 and 5, the actuator 10 comprises a body 12, typically made of non-conductive material, and defining an internal cavity 14.

The internal cavity 14 is typically of circular cross-section, having a central axis X1. In other embodiments, however, the cavity 14 could naturally present a cross-section that is rectangular or of any other appropriate shape.

The internal cavity 14 houses a part of a bus bar 16 adapted to electrically connect two external electrical components (not shown).

The bus bar 16 crosses the internal cavity 14 and projects to the outside of the body 12 for its connection to the external components.

As shown in FIG. 2, the internal cavity 14 also houses a propelling system 50 comprising a pyrotechnic igniter 20 which acts as a gas generator, and further houses a piston 30 slidably mounted along a longitudinal direction X coinciding with the axis X1 of the cavity 14.

In the present patent application, and unless stated to the contrary, an axial direction is a direction parallel to the longitudinal axis X. In addition, a radial direction is a direction perpendicular to the longitudinal axis X and intersecting said axis. Unless specified to the contrary, the adjectives and adverbs "axial" and "radial" are used with reference to the above-specified axial and radial directions.

The adjectives external and internal are generally used with reference to a radial direction.

Furthermore, the adjectives upper and lower are generally used with reference to the longitudinal direction X, the bus bar 16 being disposed in the lower part of the cavity 14, and the propelling system 50 in the upper part thereof.

As better shown in FIG. 2, the upper wall 13 of the body 12 is provided with a first recess 40 opening out into the internal cavity 14. This first recess 40 will be referred to in the following description as the central recess as it is centred on the central axis X1 of the internal cavity 14. The central recess 40 is here of substantially circular cross-section.

The first recess 40 has a diameter D1 measured in a radial direction at its bottom face 40*a*.

In the illustrated example, the pyrotechnic igniter 20 is mounted in said first recess 40 of the body 12.

The pyrotechnic igniter 20 comprises here a main portion or body 22 of cylindrical shape, with an upper face 22*a*, a lower face 22*b*, and an external face 22*c* of cylindrical shape joining together the upper and lower face 22*a*, 22*b*.

The pyrotechnic igniter 20 is further provided with conductive pins 24 protruding from said main portion 22 and adapted to be connected to a control unit (not shown) as described hereafter. The pyrotechnic igniter 20 is mounted so that the conductive pins 24 pass through an opening 42 formed in the upper wall 13 of the body 12 and through a retainer 52 located in a housing 44 opening out axially to the outside, here delimited by said upper wall 13. The retainer, as is well-known, forms an interface of the actuator 10 to which an electrical connector may be plugged, the connector being generally connected to the control unit and adapted for transmitting an electrical actuation signal emitted by the control unit, to the pyrotechnic igniter 20.

As shown in FIG. 2, the pyrotechnic igniter 20 abuts against the bottom face 40*a* of the central recess 40 with its upper face 22*a*.

The diameter D2 of the pyrotechnic igniter 20 is, however, less than the diameter D1 of the central recess 40. A radial gap 60 is therefore formed, inside the cavity 14, between the pyrotechnic igniter 20 and the body 12. The gap 60 has a substantially annular shape, extending around a main axis X2, which, in the example, coincides with the axis of the pyrotechnic igniter 20 and the longitudinal axis X. The gap 60 is delimited by an internal face of the body 12, here formed by the internal face 40*c* of the central recess 40, and by the external face 22*c* of the pyrotechnic igniter 20.

Figure 3:
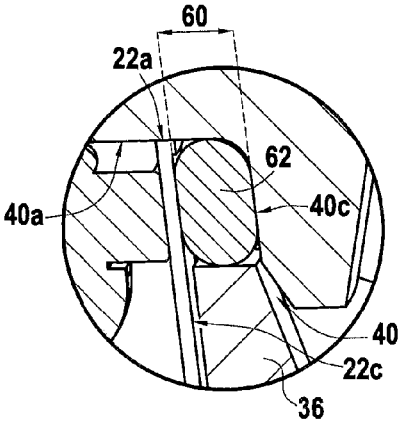
FIG. 3 is a view of detail III in FIG. 2.

As shown in FIGS. 2 and 3, a sealing gasket 62 is mounted in the gap 60, surrounding the pyrotechnic igniter 20.

The sealing gasket 62 is radially compressed between the internal face 40*c* of the central recess 40 and the external face 22*c* of the pyrotechnic igniter 20, whereby the pyrotechnic igniter 20 is reliably kept in place with respect to the body, with no need of further holding means such as bonding means.

In the example, the sealing gasket 62 is an O-ring, having typically a circular cross-section (in a plane parallel to the axis of the sealing gasket and passing through this axis).

It may, however, take any appropriate shape. In particular, the sealing gasket 62 may have a conical or rectangular cross-section. It may also be provided with circumferential grooves or protrusions.

The sealing gasket 62 may be formed from any suitable material, notably EPDM (ethylene-propylene terpolymer).

Also, according to a particular embodiment (not shown), the external face 22*c* of the pyrotechnic igniter might be shaped with a shoulder, a groove or a recess, adapted to receive the sealing gasket 62 and ensure that the latter be in a suitable position.

The piston 30 is mounted facing the pyrotechnic igniter 20 so that an expansion chamber 64 is defined therebetween in the non-activated state of the actuator 10. In other words, the piston 30 partially delimits the expansion chamber 64. When activated, the pyrotechnic igniter 20, which forms a gas generator, is adapted to generate gas into said expansion chamber 64 to pressurize it and propel the piston 30.

When propelled, the piston 30 moves inside the internal cavity 14, along the longitudinal direction X, between an initial position (which corresponds to the non-activated state of the actuator 10), and a second position in which it comes into contact with the bus bar 16, in order to separate it into two distinct portions, thus electrically disconnecting the external components.

Figure 8:
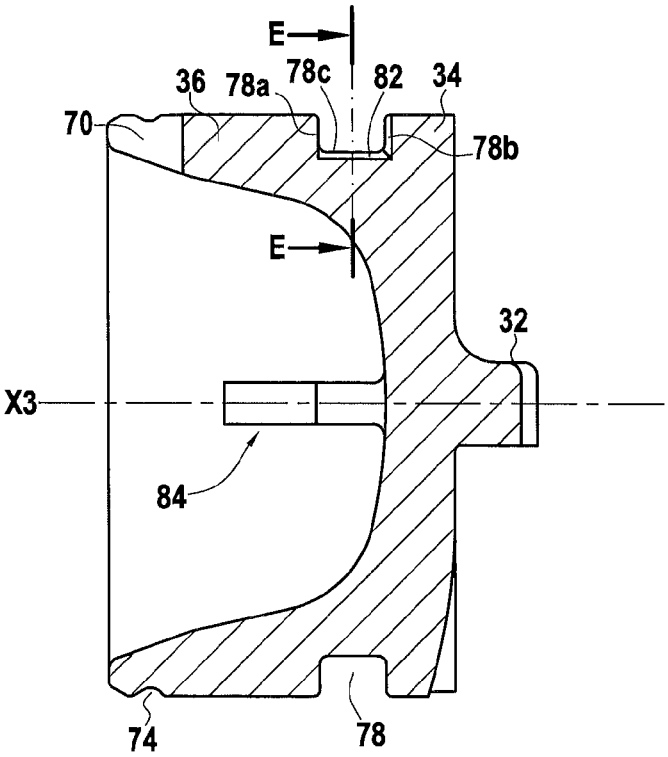
FIG. 8 is a cross-section view along the plane D-D of FIG. 7.
Figure 9:
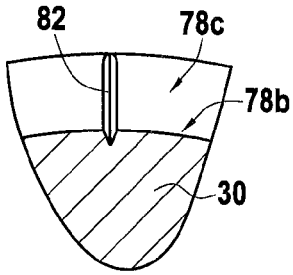
FIG. 9 is a cross-section view along the plane E-E of FIG. 8.

As shown in FIGS. 5 and 8, the piston 30 comprises, with this aim in view, a cutting edge 32, protruding from its lower face 30*b*, and adapted to come into contact with the bus bar 16, in order to break it.

In the example, the piston 30 has a main part 34 of circular cross-section complementary to that of the internal cavity 14 and extending around an axis X3 coinciding with axis X1 of the cavity 14.

A rear skirt 36 further extends from the main part 34 on its side facing the pyrotechnic igniter 20. The skirt allows increasing the sliding surface of the piston, and therefore ensures a safe displacement of the piston inside the body.

As shown in FIG. 2 or FIG. 5, the upper wall 13 of the body 12 is provided with a second recess 48, here referred to as the peripheral recess.

This peripheral recess 48 is arranged around the central recess 40, in such a manner that a rib 18—here in particular an annular rib—of the body 12 is formed between the central recess 40 and the peripheral recess 48 (said rib 18 therefore forming the internal face 48*d* of the peripheral recess 48 and the internal face 40*c* of the central recess 40).

In the example, the rib has a truncated conical shape when viewed in radial cross-section.

In the example, when in its initial position, the piston 30 is disposed such that its rear skirt 36 is inserted at least in part in said peripheral recess 48. Advantageously, in this position, the upper face 30*a* of the piston 30 abuts against the upper wall 13 of the body 12—here the bottom face 48*a* of the recess 48 (see FIG. 4). This arrangement ensures compactness of the actuator.

Figure 6:
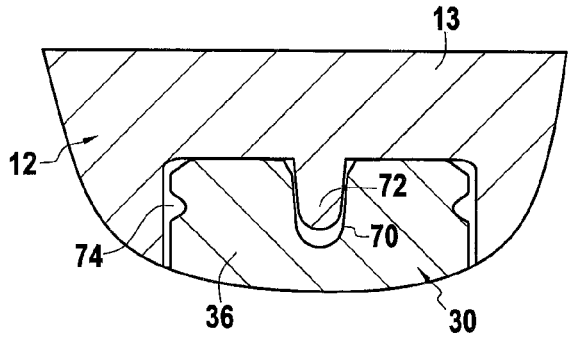
FIG. 6 is a cross-section view along the plane C-C of FIG. 5.
Figure 7:
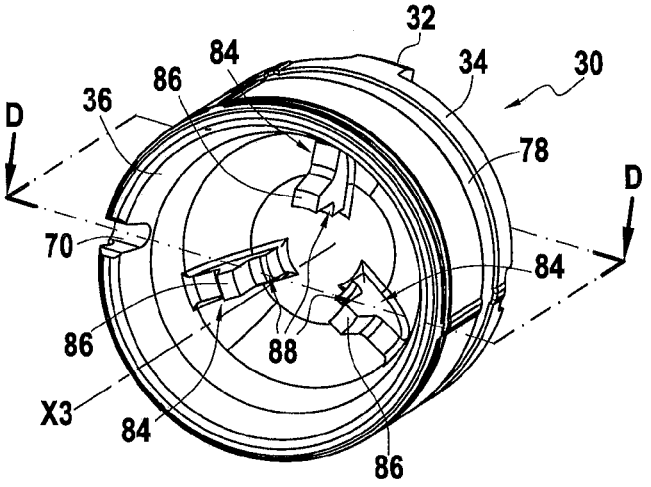
FIG. 7 is a perspective upper view of the piston of FIGS. 1 to 6.

As shown in FIG. 5, and more particularly in FIGS. 6 and 7, the actuator 10 further comprises an indexing system for indexing the piston 30 with respect to the body 12 in a defined angular position around axis X (X1, X2).

Typically, a slit 70 is formed in the upper part of the piston 30 and the upper wall 13 of the body 12 is provided with a corresponding protrusion 72 protruding downwards.

In the illustrated example, the slit 70 is formed by a notch formed at the distal end of the rear skirt 36 of the piston 30 (see in particular FIG. 7), and the protrusion 72 is formed by a step provided inside the peripheral recess 48 (see FIG. 5).

The step 72 is adapted to engage in the notch 70 for one angular position of the piston 30 around axis X (X1, X2), which position corresponds to the desired angular position of the piston 30 when in its initial position.

It is to be noted that the above-mentioned example is not limitative. According to an alternative embodiment, the indexing system may for example comprise a protrusion formed on the piston 30 (notably a tapered-shaped protrusion, in particular a conical or truncated protrusion) and a corresponding recess (notably a blind hole) formed in the body 12.

Figure 4:
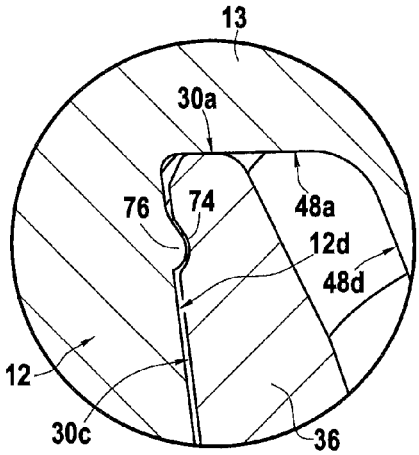
FIG. 4 is a view of detail IV in FIG. 2.

As shown in FIG. 4, the piston 30 is further provided with a recess 74 on its external face 30*c* and the body 12 is provided with a bulge 76 on its inner face 12*d*. Said recess 74 and bulge 76 form engagement means which cooperate to releasably attach the piston 30 to the body 12 in its initial position.

It is to be noted that, according to another embodiment, the at least one bulge may be provided on the piston and the at least one corresponding recess may be provided on the body. All features described hereafter apply similarly to such embodiment.

In the illustrated example, the recess 74 is a groove extending continuously all along the outer periphery of the piston 30, and the bulge 76 is formed by a circumferential rib extending continuously all along the inner periphery of the body.

However, the recess 74 and bulge 76 may have any appropriate shape, adapted to engage in the recess 74.

The bulge 76 may be formed of a rib extending on a limited angular portion of the inner circumference of the body 12. More preferably, the body 12 may be provided with two or more rib segments each extending on a limited angular portion of the circumference, notably between 2 to 4 segments.

The choice of a suitable dimension (notably angular dimension) of the bulge(s) and recess(es) allows the adjustment of the unlocking force of the piston 30 from its initial position.

In the example, and as shown for instance in FIGS. 2, 5 and 8, the piston 30 further comprises on its external face a groove 78 in which is arranged a second sealing gasket 80.

A calibrated passage 82 adapted to evacuate gas is formed between the second sealing gasket 80 and the wall of said groove 78.

Such calibrated passage 82 generates a local decompression of the second sealing gasket 80, allowing a small leakage of air from the space delimited by the body 12, pyrotechnic igniter 20 and piston 30, when the piston 30 is mounted in the internal cavity 14. In particular, such leakage passage avoids the so-called "pumping effect" when assembling the piston inside the body. However, it is dimensioned to have no significant effect on the pressurization of the expansion chamber 64 when the pyrotechnic igniter 20 is activated.

In the example, the calibrated passage 82 if formed of a (here-V-shaped) slot formed in the wall(s) of the groove 78.

Here, as shown in FIG. 8, the groove 78 has a bottom wall 78*c*, an upper lateral wall 78*a* (closer to the upper wall of the body 12) extending from an inlet of the groove to the bottom wall, and a lower lateral wall 78*b* (closer to the lower wall of the body 12) extending from the bottom wall 78*c* to an outlet of the groove. In the illustrated example, the slot 82 comprises a segment formed in the bottom wall 78*c* of the groove 78 and a segment formed on the lower lateral wall 78*b* of said groove 78, but no segment in the upper lateral wall 78*a* thereof.

With such arrangement, when the piston 30 is mounted into the cavity (it is introduced from the bottom thereof and pushed upwards), the second sealing gasket 80 is pushed toward the lower wall 78*b* due to the air pressure inside the cavity 14. The air contained in the cavity may so escape through the gap formed between the upper lateral wall 78*a* and the sealing gasket 80, and through the slot 82.

Once the piston 30 is in its initial position, on the contrary, the expansion chamber 64 is kept isolated from the lower part of the cavity 14 by the sealing gasket 80, which leans on the upper lateral wall 78*a* of the groove 78.

However, the illustrated example is not limitative, and that the slot may for example extend continuously over the entire internal contour of the groove.

In the illustrated embodiment, the piston 30 is further provided with blocking means adapted to block the propelling system 50 in the longitudinal direction X when it is in the initial position.

In the example, as shown notably in FIG. 7, said blocking means comprise three protrusions 84, projecting from the upper face of the piston 30 (i.e. its bowl-shaped face facing the pyrotechnic igniter 20), in particular from the main part 34 of the piston 30, and regularly distributed circumferentially around the axis X3 thereof.

It is to be noted that the number of protrusions 84 is not limited, and the piston 30 may be provided with one, two or more than three protrusions 84 without departing from the scope of the invention.

The protrusions may be adjusted in thickness (or volume) in order to control the volume of the expansion chamber 64 and so, the pyrotechnic pressure provided by the pyrotechnic igniter when it is actuated.

In the example, each protrusion 84 has a first part 86 in the form of a pin adapted (that is, in particular, positioned and shaped) to be inserted in the gap 60 to block the sealing gasket 62 when the piston 30 is in the initial position.

In the example, the pin 86 simply abuts against the sealing gasket 62.

According to another embodiment, the pin 86 could also mechanically cooperate with the sealing gasket 82 to impart thereon a compression force, oriented towards the upper wall 13 of the body 12.

According to still another embodiment, the pin 86 could also be remote from the sealing gasket 62, so as to allow a small displacement thereof in the longitudinal direction X.

In the example, each protrusion 84 further has a second part 88 configured to cooperate with the pyrotechnic igniter 20 in a shape-fitting manner when the piston 30 is in the initial position.

Here, the second part 88 forms a shoulder protruding from the pin 86 so as to form therewith a substantially L-shaped arm, adapted to engage respectively the lower face 22*b* and external circumferential face 22*c* of the pyrotechnic igniter 20.

In the example, the second part 88 simply abuts against the igniter 20. However, similarly to the first part 86, the second part 88 may also apply a compressive force on the igniter 20, or may be remote therefrom.

It is to be noted that, according to alternative embodiments, each protrusion may also comprise only one of the first and second part described hereabove.

The piston 30, which is safely maintained in its initial position due to the engagement means, blocks the propelling system in the longitudinal direction X due to its blocking parts 86, 88. The sealing gasket and pyrotechnic igniter are so reliably maintained in position, ensuring a proper functioning of the actuator upon activation.

The invention claimed is:

1. A pyrotechnic actuator comprising:

a body, a piston slidably mounted inside the body along a longitudinal direction, and a propelling system comprising a pyrotechnic igniter mounted inside said body and adapted to propel said piston, the pyrotechnic igniter being mounted inside the body such that a peripheral gap is formed between the body and the pyrotechnic igniter, and the propelling system further comprises a sealing gasket arranged inside the peripheral gap, the sealing gasket being compressed inside the peripheral gap in a direction substantially perpendicular to a main axis of the pyrotechnic igniter such that the pyrotechnic igniter is maintained in position with respect to the body, wherein the pyrotechnic igniter and the sealing gasket are disposed in a first recess formed in a wall of the body, and wherein the body has a peripheral recess surrounding the first recess, and wherein the piston is provided with a skirt formed on a first side facing the pyrotechnic igniter, the skirt being mounted in said peripheral recess when the piston is in an initial position.

2. The pyrotechnic actuator according to claim 1, wherein the peripheral gap extends around a main axis and is delimited by an internal face of the body substantially parallel to said main axis, and the sealing gasket arranged inside the peripheral gap contacts said internal face of the body.

3. The pyrotechnic actuator according to claim 1, wherein the peripheral gap extends around the main axis.

4. The pyrotechnic actuator according to claim 3, wherein the piston comprises a blocking system adapted to block the propelling system in the longitudinal direction when the piston is in the initial position.

5. The pyrotechnic actuator according to claim 4, wherein the blocking system comprises at least one blocking part configured to cooperate with the pyrotechnic igniter in a shape-fitting manner when the piston is in the initial position.

6. The pyrotechnic actuator according to claim 4, wherein the blocking system comprises at least one blocking part configured to be inserted in the peripheral gap to block the sealing gasket when the piston is in the initial position.

7. The pyrotechnic actuator according to claim 3, further comprising:

an engagement system configured to releasably attach the piston with respect to the body in the initial position.

8. The pyrotechnic actuator according to claim 7, wherein the engagement system comprises:

at least a second recess formed on one of: a first external face of the piston, and a first internal face of the body, and at least a bulge formed on a second external face of the piston and a second internal face of the body, the second recess and the bulge being adapted to engage each other to block the piston with respect to the body in the longitudinal direction.

9. The pyrotechnic actuator according to claim 3, wherein the piston has a cylindrical shape having a longitudinal axis, and the pyrotechnic actuator further comprising:

an indexing system for indexing the piston with respect to the body in a defined angular position around the longitudinal axis.

10. The pyrotechnic actuator according to claim 9, wherein the indexing system comprises:

at least one slit formed on one of the piston and the body, and at least one corresponding rib formed on the other of the piston and the body, the at least one slit and the at least one corresponding rib being configured to cooperate in the defined angular position of the piston.

11. The pyrotechnic actuator according to claim 3, wherein the piston includes an external face and the piston comprises on said external face a groove in which is arranged a second sealing gasket, and a calibrated passage adapted to evacuate gas is formed between the second sealing gasket and a wall of said groove.

12. The pyrotechnic actuator according to claim 1, wherein the sealing gasket being stationary relative to the body and the pyrotechnic igniter.

13. The pyrotechnic actuator according to claim 1, wherein the sealing gasket is configured to provide a sealing between the pyrotechnic igniter and the body.

14. The pyrotechnic actuator according to claim 1, wherein the sealing gasket is configured to provide a sealing function and a holding function for the pyrotechnic igniter.

15. The pyrotechnic actuator according to claim 1, wherein the pyrotechnic igniter is maintained in position with respect to the body via sealing gasket such that no further holding means are needed.

16. The pyrotechnic actuator according to claim 15, wherein the further holding means comprise bonding means.

17. The pyrotechnic actuator according to claim 1, wherein the sealing gasket being compressed inside the peripheral gap in the direction substantially perpendicular to the main axis of the pyrotechnic igniter comprises the sealing gasket being radially compressed between an internal face of the first recess and an external face of the pyrotechnic igniter.

* * * * *